US010544497B2

(12) United States Patent
Oh et al.

(10) Patent No.: US 10,544,497 B2
(45) Date of Patent: Jan. 28, 2020

(54) ZN ALLOY PLATED STEEL SHEET HAVING EXCELLENT PHOSPHATABILITY AND SPOT WELDABILITY AND METHOD FOR MANUFACTURING SAME

(71) Applicant: POSCO, Pohang-si, Gyeongsangbuk-do (KR)

(72) Inventors: Min-Suk Oh, Gwangyang-si (KR); Sang-Heon Kim, Gwangyang-si (KR); Tae-Chul Kim, Gwangyang-si (KR); Jong-Sang Kim, Gwangyang-si (KR); Bong-Hwan Yoo, Gwangyang-si (KR); Hyun-Chu Yun, Seoul (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 263 days.

(21) Appl. No.: 15/539,622

(22) PCT Filed: Dec. 24, 2015

(86) PCT No.: PCT/KR2015/014253
§ 371 (c)(1),
(2) Date: Jun. 23, 2017

(87) PCT Pub. No.: WO2016/105157
PCT Pub. Date: Jun. 30, 2016

(65) Prior Publication Data

US 2019/0100831 A1 Apr. 4, 2019

(30) Foreign Application Priority Data

Dec. 24, 2014 (KR) ..... 10-2014-0188046

(51) Int. Cl.

| | |
|---|---|
| ***C22C 18/00*** | (2006.01) |
| ***C23C 2/06*** | (2006.01) |
| ***C23C 2/16*** | (2006.01) |
| ***C23C 2/40*** | (2006.01) |
| ***C23C 2/02*** | (2006.01) |
| *C22C 18/04* | (2006.01) |

(52) U.S. Cl.
CPC ..... *C23C 2/06* (2013.01); *C23C 2/02* (2013.01); *C23C 2/16* (2013.01); *C23C 2/40* (2013.01); *C22C 18/04* (2013.01)

(58) Field of Classification Search
CPC .... C23C 2/06; C23C 2/02; C23C 2/16; C23C 2/28; C23C 2/40; C22C 18/04
USPC ..... 148/533; 420/520
See application file for complete search history.

(56) References Cited

U.S. PATENT DOCUMENTS

| | | | | |
|---|---|---|---|---|
| 6,235,410 | B1 | 5/2001 | Komatsu et al. | |
| 6,465,114 | B1 * | 10/2002 | Honda | C23C 2/02 148/264 |
| 2003/0003321 | A1 | 1/2003 | Sugimaru et al. | |
| 2009/0053555 | A1 * | 2/2009 | Nose | C22C 18/00 428/653 |
| 2010/0086806 | A1 | 4/2010 | Koumura et al. | |
| 2012/0282488 | A1 * | 11/2012 | Fujii | C23C 2/06 428/677 |
| 2013/0183541 | A1 | 7/2013 | Kim et al. | |
| 2013/0337287 | A1 * | 12/2013 | Hirata | C21D 8/0205 428/659 |
| 2018/0371596 | A1 * | 12/2018 | Sohn, Il | C23C 2/06 |

FOREIGN PATENT DOCUMENTS

| | | | | |
|---|---|---|---|---|
| CN | 1193113 | C | 3/2005 | |
| CN | 1261614 | C | 6/2006 | |
| CN | 101558182 | A1 | 10/2009 | |
| CN | 103282533 | A | 9/2013 | |
| CN | 103361588 | A | 10/2013 | |
| JP | H08-060324 | A | 5/1996 | |
| JP | h09-249956 | A | 9/1997 | |
| JP | S10-226863 | A | 8/1998 | |
| JP | H10-306357 | A | 11/1998 | |
| JP | 2001-295018 | A | 10/2001 | |
| JP | 2002-030405 | A | 1/2002 | |
| JP | 2002-285311 | * | 10/2002 | C22C 18/00 |
| JP | 2002-285311 | A | 10/2002 | |
| JP | 2002-332555 | A | 11/2002 | |
| JP | 2004-360056 | A | 12/2004 | |
| JP | 2010-275633 | A | 12/2010 | |
| JP | 2014-501334 | A | 1/2014 | |
| KR | 10-2007-0029267 | A | 3/2007 | |
| KR | 10-2009-0063216 | A | 6/2009 | |
| KR | 10-2009-0122346 | A | 11/2009 | |
| KR | 10-2012-0075235 | A | 7/2012 | |
| KR | 10-2014-0043471 | A | 4/2014 | |
| WO | 2006/002843 | A1 | 1/2006 | |
| WO | 2008/102009 | A1 | 8/2008 | |
| WO | 2012/091385 | A2 | 7/2012 | |

OTHER PUBLICATIONS

Extended European Search Report dated Jan. 29, 2018 issued in European Patent Application No. 15873684.3.
Japanese Office Action dated Oct. 30, 2018 issued in Japanese Patent Application No. 2017-533756.
Chinese Office Action dated Nov. 2, 2018 issued in Chinese Patent Application No. 201580070784.8.

(Continued)

*Primary Examiner* — Patricia L. Hailey
(74) *Attorney, Agent, or Firm* — Morgan, Lewis & Bockius LLP

(57) ABSTRACT

A Zn alloy plated steel sheet having excellent phosphatability and spot weldability and a method for manufacturing the same are provided. In the Zn alloy plated steel sheet including a base steel sheet and a Zn alloy plating layer, the Zn alloy plating layer includes, by wt %, Al: 0.5-2.8%, Mg: 0.5-2.8%, and a remainder of Zn and inevitable impurities, and a cross-sectional structure of the Zn alloy plating layer includes, by area percentage, more than 50% of a Zn single phase structure and less than 50% of a Zn—Al—Mg-based intermetallic compound. A surface structure of the Zn alloy plating layer includes, by area percentage, 40% or less of a Zn single phase structure and 60% or more of a Zn—Al—Mg-based intermetallic compound.

21 Claims, 3 Drawing Sheets

(56) References Cited

OTHER PUBLICATIONS

D. K. Reiner, et al., "Nano-Characterisation of the Surface of HDG Zn—Al—Mg-Coated Steel Sheet," Galvatech 2011, 8th International Conference on Zinc and Zinc Alloy Coated Steel Sheet, Genova Italy, Jun. 21-24, 2011.
N. LeBozec, et al., "Effect of carbon dioxide on the atmospheric corrosion of Zn—Mg—Al coated steel," Corrosion Science, 74 (2013) pp. 379-386.
International Search Report dated Apr. 8, 2016 issued in International Patent Application No. PCT/KR2015/014253 (with English translation).

* cited by examiner

【Fig.1】
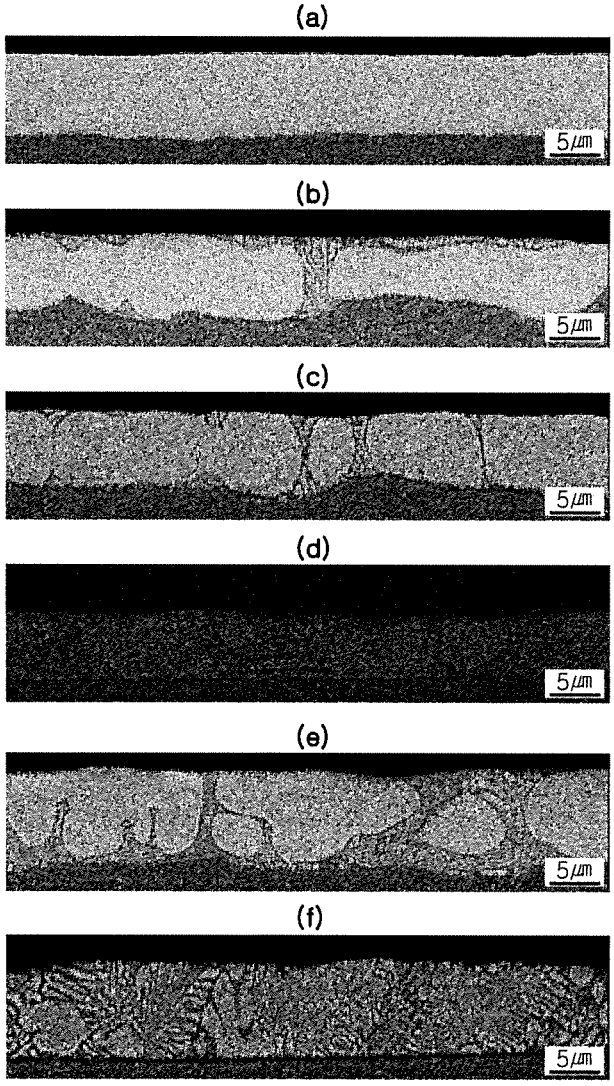

【Fig.2】
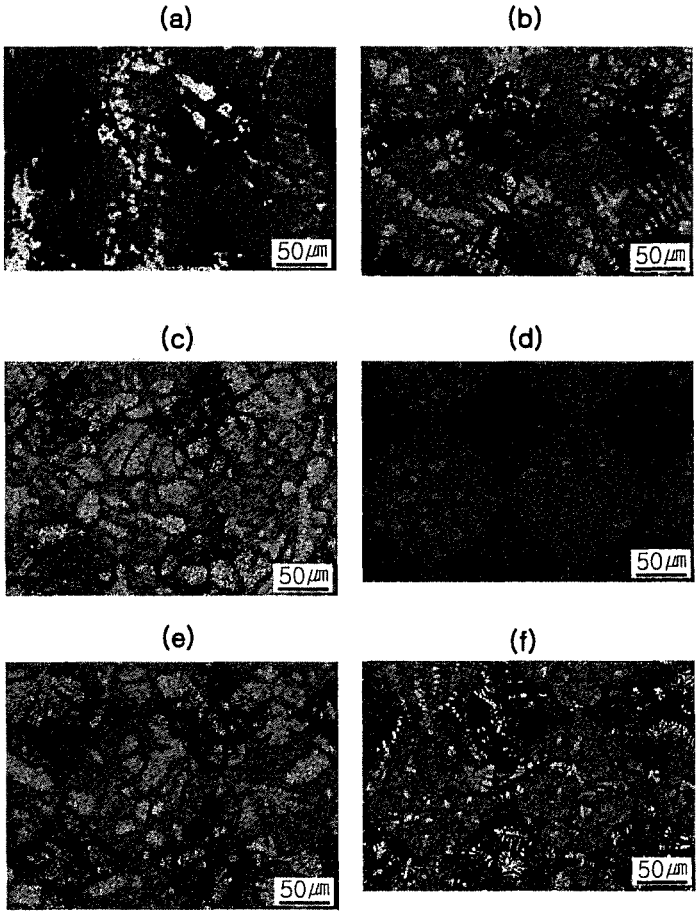

【Fig.3】
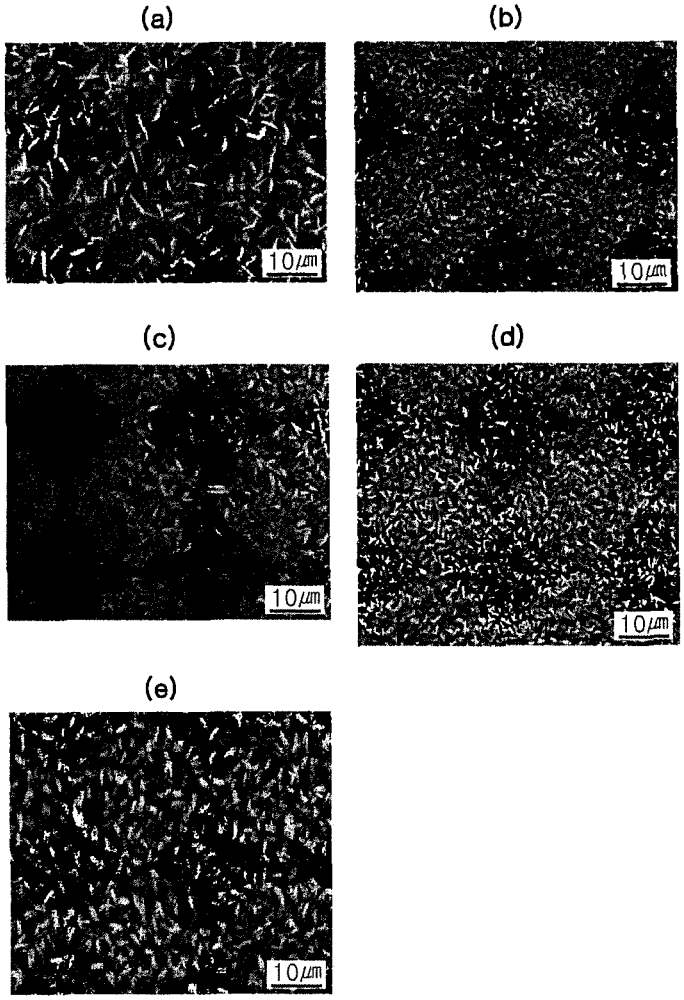

ZN ALLOY PLATED STEEL SHEET HAVING EXCELLENT PHOSPHATABILITY AND SPOT WELDABILITY AND METHOD FOR MANUFACTURING SAME

CROSS REFERENCE

This patent application is the U.S. National Phase under 35 U.S.C. § 371 of International Application No. PCT/KR2015/014253, filed on Dec. 24, 2015, which claims the benefit of Korean Patent Application No. 10-2014-0188046, filed on Dec. 24, 2014 and Korean Patent Application No. 10-2015-0185499, filed on Dec. 23, 2015, the entire contents of each are hereby incorporated by reference.

TECHNICAL FIELD

The present disclosure relates to a zinc alloy plated steel sheet having excellent phosphatability and spot weldability and a method of manufacturing the same.

BACKGROUND ART

Recently, a zinc plated steel sheet has been widely used in household appliances, automobiles, and the like, so there is increasing demand for zinc plated steel sheets. In order to increase the plating adhesion of a zinc plated steel sheet, excellent phosphatability has been required therein. However, in a zinc plated steel sheet according to the related art, during solidification of zinc plated on a surface of a steel sheet, a zinc crystal grain, referred to as a spangle, may be formed, and such a spangle may remain on a surface of a steel sheet after solidification, so there is a disadvantage in that phosphatability may be inferior.

To negate such a disadvantage, a plating technique of mixing various added elements to a plating layer has been proposed. As a representative example, a zinc alloy plated steel sheet, improving phosphatability of a steel sheet by forming a Zn—Mg—Al-based intermetallic compound by adding an element such as aluminum (Al), magnesium (Mg), and the like, to a plating layer, may be cited. However, in such a Zn—Mg—Al-based intermetallic compound in a zinc alloy plated steel sheet, a melting point thereof is rather low, so melting occurs easily during welding. Thus, there is a disadvantage in that spot weldability of a plated steel sheet may be deteriorated.

DISCLOSURE

Technical Problem

An aspect of the present disclosure may provide a zinc alloy plated steel sheet having excellent phosphatability and spot weldability and a method of manufacturing the same.

The object of the present invention is not limited to the above description. Additional objects and advantages of the invention will be set forth in part in the description which follows, and those of ordinary skill in the art will readily understand the additional objects of the present invention from this application.

Technical Solution

According to an aspect of the present disclosure, a zinc alloy plated steel sheet having excellent phosphatability and spot weldability is provided, the zinc alloy plated steel sheet including a base steel sheet and a zinc alloy plating layer, wherein the zinc alloy plating layer includes, by wt %, 0.5% to 2.8% of Al and 0.5% to 2.8% of Mg, with a remainder of Zn and inevitable impurities, a sectional structure of the zinc alloy plating layer includes a Zn single phase structure of more than 50% by area percentage and a Zn—Al—Mg-based intermetallic compound of less than 50%, and a surface structure of the zinc alloy plating layer includes a Zn single phase structure of 40% or less by area percentage and a Zn—Al—Mg-based intermetallic compound of 60% or more.

According to another aspect of the present disclosure, a method of manufacturing a zinc alloy plated steel sheet includes: preparing a zinc alloy plating bath including, by wt %, 0.5% to 2.8% of Al and 0.5% to 2.8% of Mg, with a remainder of Zn and inevitable impurities; immersing a base steel sheet in the zinc alloy plating bath, and obtaining a zinc alloy plated steel sheet by performing plating; gas wiping the zinc alloy plated steel sheet; primary cooling the zinc alloy plated steel sheet at a primary cooling rate of 5° C./sec or less (excluding 0° C./sec) to a primary cooling end temperature of more than 380° C. to 420° C. or less, after the gas wiping; maintaining the zinc alloy plated steel sheet at a constant temperature for at least one second at the primary cooling end temperature, after the primary cooling; and secondary cooling the zinc alloy plated steel sheet at a secondary cooling rate of 10° C./sec or more to a secondary cooling end temperature of 320° C. or less, after the maintaining the zinc alloy plated steel sheet at a constant temperature.

Advantageous Effects

According to an exemplary embodiment in the present disclosure, a zinc alloy plated steel sheet has excellent phosphatability and excellent spot weldability.

DESCRIPTION OF DRAWINGS

FIG. 1 is scanning electron microscope (SEM) images of a cross-sectional structure of a zinc alloy plated steel sheet according to an exemplary embodiment.

FIG. 2 is SEM images of a surface structure of a zinc alloy plated steel sheet according to an exemplary embodiment.

FIG. 3 is images of a surface of a zinc alloy plated steel sheet according to an exemplary embodiment, after the zinc alloy plated steel sheet is phosphate-treated.

BEST MODE FOR INVENTION

The inventors of the present invention conducted various studies in order to simultaneously improve the phosphatability and spot weldability of a zinc alloy plated steel sheet, and the following findings were obtained.

(1) As a microstructure of a surface portion of a zinc alloy plating layer, a large amount of a Zn—Al—Mg-based intermetallic compound is secured, so phosphatability may be improved.

(2) On the other hand, the Zn—Al—Mg-based intermetallic compound has a low melting point, so spot weldability may be inhibited.

(3) To improve the spot weldability, as a microstructure of a zinc alloy plating layer, it is necessary to secure a large amount of a structure with a high melting point. To this end, it is preferable to secure a large amount of a Zn single phase structure.

(4) In order to obtain both (1) and (3) described above, a large amount of a Zn single phase structure is secured as a microstructure in a cross-sectional portion of a zinc alloy plating layer (a cross-sectional structure), while a large amount of a Zn—Al—Mg-based intermetallic compound is secured as a microstructure in a surface portion of the zinc alloy plating layer (a surface structure). Therefore, a zinc alloy plated steel sheet simultaneously having excellent phosphatability and spot weldability may be provided.

Hereinafter, an aspect of the present disclosure, a zinc alloy plated steel sheet having excellent phosphatability and spot weldability, will be described in detail.

An aspect of the present disclosure, a zinc alloy plated steel sheet, includes a base steel sheet and a zinc alloy plating layer. In an exemplary embodiment, a type of the base steel sheet is not particularly limited, and may be, for example, a hot-rolled steel sheet or a cold-rolled steel sheet, used as a base of a zinc alloy plated steel sheet according to the related art. However, in the case of the hot-rolled steel sheet, a large amount of oxidized scale may be formed on a surface thereof, and the oxidized scale lowers plating adhesion, so a problem in which plating quality is lowered may occur. Thus, it is more preferable to use a hot-rolled steel sheet, from which oxidized scale is removed in advance by an acid solution, as a base. On Meanwhile, the zinc alloy plating layer may be formed on one or both sides of the base steel sheet.

The zinc alloy plating layer may include, by wt %, 0.5% to 2.8% of Al and 0.5% to 2.8% of Mg, with a remainder of Zn and inevitable impurities.

Mg in the zinc alloy plating layer is an element playing a major role in improving corrosion resistance and phosphatability of a plating steel sheet by forming a Zn—Al—Mg-based intermetallic compound as Mg reacts with Zn and Al in a plating layer. If the content of Mg is significantly low, corrosion resistance of a plating layer may not be improved and a sufficient amount of a Zn—Al—Mg-based intermetallic compound in a surface structure of a plating layer may not be secured, so a problem in which an effect of improvement of phosphatability is not sufficient may occur. Thus, a lower limit of the content of Mg in the zinc alloy plating layer is preferably 0.5 wt %, more preferably 0.6 wt %, and most preferably 0.8 wt %. However, if the content of Mg is excessive, an effect of improvement of phosphatability may be saturated, and dross, related to Mg oxide, is formed in a plating bath, so a problem in which plating properties are deteriorated may occur. Furthermore, a large amount of a Zn—Al—Mg-based intermetallic compound in a cross-sectional structure of a plating layer is formed, so a problem in which spot weldability decreases may occur. Thus, an upper limit of the content of Mg in the zinc alloy plating layer is preferably 2.8 wt %, more preferably 2.5 wt %, and most preferably 2.0 wt %.

Al in the zinc alloy plating layer is an element playing a major role in improving the phosphatability of a plating steel sheet by forming a Zn—Al—Mg-based intermetallic compound as Al reacts with Zn and Mg in a plating layer, while inhibiting formation of Mg oxide dross in a plating bath. If the content of Al is significantly low, a Mg dross formation inhibitory ability may be insufficient, and a sufficient amount of a Zn—Al—Mg-based intermetallic compound in a surface structure of a plating layer may not be secured, so a problem in which an effect of improvement of phosphatability is insufficient may occur. Thus, a lower limit of the content of Al in the zinc alloy plating layer is preferably 0.5 wt %, more preferably 0.6 wt %, and most preferably 0.8 wt %. However, if the content of Al is excessive, problems, in which an effect of improvement of phosphatability is saturated and durability of a plating device is adversely affected as a plating bath temperature increases, may occur. Furthermore, a large amount of a Zn—Al—Mg-based intermetallic compound is formed in a cross-sectional structure of a plating layer, so a problem in which spot weldability decreases may occur. Thus, an upper limit of the content of Al in the zinc alloy plating layer is preferably 2.8 wt %, more preferably 2.5 wt %, and most preferably 2.0 wt %.

Meanwhile, as described above, in order to improve phosphatability and spot weldability of a zinc alloy plated steel sheet simultaneously, it is necessary to appropriately control a position distribution of a Zn single phase structure and a Zn—Al—Mg-based intermetallic compound in a plating layer. In this case, the Zn—Al—Mg-based intermetallic compound may be at least one selected from the group consisting of a $Zn/Al/MgZn_2$ ternary eutectic structure, a $Zn/MgZn_2$ binary eutectic structure, a Zn—Al binary eutectic structure, and an $MgZn_2$ single phase structure.

A cross-sectional structure of the zinc alloy plating layer preferably includes, by area percentage, a Zn single phase structure of more than 50% (excluding 100%), more preferably a Zn single phase structure of 55% or more (excluding 100%), and most preferably a Zn single phase structure of 60% or more (excluding 100%). Here, the cross-sectional structure refers to a microstructure observed in a cut section of a zinc alloy plating layer, when a zinc alloy plated steel sheet is cut vertically, that is, in a sheet thickness direction from a surface thereof. As described above, as an area percentage of a Zn single phase structure in a cross-sectional structure is higher, it is advantageous in improving spot weldability. Thus, in an exemplary embodiment, only a lower limit of an area percentage of a Zn single phase structure in a cross-sectional structure for securing desired spot weldability is limited, and an upper limit thereof is not particularly limited. The remainder, except for the Zn single phase structure, is formed of a Zn—Al—Mg-based intermetallic compound.

A surface structure of the zinc alloy plating layer preferably includes, by area percentage, a Zn—Al—Mg-based intermetallic compound of 60% or more (excluding 100%), more preferably a Zn—Al—Mg-based intermetallic compound of 70% or more (excluding 100%), and most preferably a Zn—Al—Mg-based intermetallic compound of 75% or more (excluding 100%). Here, the surface structure refers to a microstructure observed in a surface of a zinc alloy plated steel sheet. As described above, as an area percentage of a Zn—Al—Mg-based intermetallic compound in a surface structure is higher, it is advantageous in improving phosphatability of a zinc alloy plated steel sheet. Thus, in an exemplary embodiment, only a lower limit of an area percentage of a Zn—Al—Mg-based intermetallic compound in a surface structure for securing desired phosphatability is limited, and an upper limit thereof is not particularly limited. The remainder, except for the Zn—Al—Mg-based intermetallic compound, is formed of a Zn single phase structure.

According to an example, when an area percentage of a Zn single phase structure of the cross-sectional structure is a, and an area percentage of a Zn single phase structure of the surface structure is b, a ratio of b to a (b/a) is 0.8 or less, preferably 0.5 or less, and more preferably 0.4 or less. As described above, the ratio of an area percentage of the Zn single phase structure is appropriately controlled, so desired spot weldability and phosphatability may be secured simultaneously.

A method of controlling a position distribution of the Zn single phase structure and the Zn—Al—Mg-based intermetallic compound in a plating layer, described above, may be provided as various methods, so that the method of controlling the position distribution thereof is not particularly limited. However, by way of example, as will be described later, when a plating layer in a molten state is cooled, a two-step cooling method is introduced, so the position distribution described above may be obtained.

Additionally, the contents of Al, Fe, and the like, solid-dissolved in a Zn single phase structure, are appropriately controlled, so corrosion resistance of a zinc alloy plated steel sheet may be further improved.

According to the related art, as an area percentage of a Zn single phase structure is high, it is known that corrosion resistance of a zinc alloy plated steel sheet is lowered, in this regard, because, due to a corrosion potential difference between the Zn single phase structure and the Zn—Al—Mg-based intermetallic compound, local corrosion occurs in the Zn single phase structure under a corrosive environment. Thus, research is underway to inhibit a fraction of a Zn single phase structure and to significantly increase a fraction of a Zn—Al—Mg-based intermetallic compound, in a technical field, in which excellent corrosion resistance is required.

However, in an exemplary embodiment, rather than by inhibiting a fraction of a Zn single phase structure, by significantly increasing the contents of Al, Fe, and the like, solid-dissolved in a Zn single phase structure, a corrosion potential difference between the Zn single phase structure and the Zn—Al—Mg-based intermetallic compound is lowered, so as to improve corrosion resistance of a zinc alloy plated steel sheet. In detail, a Zn single phase structure is allowed to contain Al and Fe to be supersaturated, so as to improve corrosion resistance of a zinc alloy plated steel sheet.

On a phase diagram, a solid solution limit of Al with respect to Zn is 0.05 wt % and a solid solution limit of Fe with respect to Zn is 0.01 wt %. Here, a case, in which a Zn single phase structure contains Al and Fe to be supersaturated, refers to a case, in which a Zn single phase structure includes more than 0.05 wt % of Al and more than 0.01 wt % of Fe.

According to an example, the Zn single phase structure may include 0.8 wt % or more of Al, and preferably 1.0 wt % or more of Al.

According to an example, the content of Al contained in the zinc alloy plating layer is c, and the content of Al contained in the Zn single phase structure is d, a ratio of d to c (d/c) may be 0.6 or more, and preferably 0.62 or more.

According to an example, the Zn single phase structure may include 1.0 wt % or more of Fe, and preferably 1.5 wt % or more of Fe.

When a Zn single phase structure contains Al and Fe to be supersaturated, an effect of improvement of corrosion resistance may be obtained. However, when the contents of Al and Fe are controlled to be within the range described above, an effect of significant improvement of corrosion resistance may be obtained.

Meanwhile, as the contents of Al and Fe contained in a Zn single phase structure are higher, it is advantageous in improving corrosion resistance. Thus, in an exemplary embodiment, an upper limit of the contents of Al and Fe is not particularly limited. However, if the sum of the contents of Al and Fe is significantly high, workability of a zinc alloy plated steel sheet may be deteriorated. In terms of preventing deterioration of workability, the sum of the contents of Al and Fe contained in the Zn single phase structure may be limited to 8.0 wt % or less, and preferably 5.0 wt % or less.

According to an example, the Zn single phase structure may include 0.05 wt % or less (including 0 wt %) of Mg. On a phase diagram, a solid solution limit of Mg with respect to Zn is 0.05 wt %. Here, a case, in which 0.05 wt % or less (including 0 wt %) of Mg is included, refers to a case, in which a Zn single phase structure includes a solid solution limit or less of Mg.

As a research result of the present inventors, Mg contained in a Zn single phase structure has no significant effect on corrosion resistance of a zinc alloy plated steel sheet. However, if the content of Mg is excessive, workability of a zinc alloy plated steel sheet may be deteriorated. Thus, it is preferable to manage the content of Mg contained in a Zn single phase structure to a solid solution limit or less.

Here, a method of measuring concentrations of Al, Fe, and Mg, contained in a Zn single phase structure, is not particularly limited, and a following method may be used by way of example. In other words, after a zinc alloy plated steel sheet is vertically cut, a cross-sectional image thereof is taken at a magnification of 3,000 times on a field emission scanning electron microscope (FE-SEM), and an energy dispersive spectroscopy (EDS) is used to point-analyze a Zn single phase structure, so concentrations of Al, Fe, and the like, may be measured.

The method of controlling the contents of Al, Fe, and the like, solid-dissolved in a Zn single phase structure, described above, may be provided as various methods, and is not particularly limited in an exemplary embodiment. However, by way of example, as will be described later, a plating bath insertion temperature of a base steel sheet and a plating bath temperature are appropriately controlled, or a cooling method during primary cooling is appropriately controlled, so the contents of Al, Fe, and the like, described above, may be obtained.

As described previously, a zinc alloy plated steel sheet according to an exemplary embodiment described above may be manufactured in various methods, and a method of manufacturing the same is not particularly limited. However, the zinc alloy plated steel sheet may be manufactured in a following method by way of example.

First, after a base steel sheet is prepared, surface activation of the base steel sheet is performed. The surface activation allows a reaction between the base steel sheet and a plating layer during hot dipping which will be described later to be activated. As a result, the surface activation also has a significant effect on the contents of Al, Fe, and the like, contained in a Zn single phase structure. However, the surface activation is not necessarily performed, and may be omitted in some cases.

In this case, an arithmetical average roughness Ra of the base steel sheet, having been surface activated, may be 0.8 μm to 1.2 μm, more preferably 0.9 μm to 1.15 μm, and most preferably 1.0 μm to 1.1 μm. Here, the arithmetical average roughness Ra refers to an average height from a centerline (an arithmetical mean line of profile) to a cross-sectional curve.

When the arithmetical average roughness Ra of a base steel sheet is controlled to be within the range described above, it is helpful in controlling the contents of Al, Fe, and the like, contained in a Zn single phase structure to be within a desired range.

A method of activating a surface of the base steel sheet is not particularly limited, and surface activation of the base steel sheet may be performed, for example, in a plasma treatment or an excimer laser treatment. During the plasma treatment or the excimer laser treatment, specific process conditions are not particularly limited, and any device and/or condition may be applied as long as a surface of a base steel sheet is uniformly activated.

Thereafter, after a zinc alloy plating bath including, by wt %, 0.5% to 2.8% of Al and 0.5% to 2.8% of Mg, with a remainder of Zn and inevitable impurities is prepared, a base steel sheet is immersed in the zinc alloy plating bath, and a zinc alloy plated steel sheet is obtained by performing plating.

In this case, a plating bath temperature is preferably 440° C. to 460° C., and more preferably 445° C. to 455° C. In addition, a surface temperature of a base steel sheet entering a plating bath is higher than the plating bath temperature, by preferably 5° C. to 20° C., and by more preferably 10° C. to 15° C. Here, the surface temperature of a base steel sheet entering a plating bath refers to a surface temperature of a base steel sheet immediately before or immediately after immersing the base steel sheet into a plating bath.

The plating bath temperature and the surface temperature of a base steel sheet entering a plating bath have a significant influence on development and growth of a $Fe_2Al_5$ inhibition layer formed between a base steel sheet and a zinc alloy plating layer, and have a significant influence on the contents of Al and Fe eluted in a plating layer, thereby having a significant influence on the contents of Al, Fe, and the like, contained in a Zn single phase structure.

The plating bath temperature is controlled to be within a range of 440° C. to 460° C., and the surface temperature of a base steel sheet entering a plating bath is controlled to be higher than the plating bath temperature by 5° C. to 20° C. Thus, the contents of Al, Fe, and the like, contained in a Zn single phase structure may be appropriately secured.

Next, gas wiping is applied to the zinc alloy plated steel sheet to adjust a plating adhesion amount. In order to smoothly control a cooling rate and prevent surface oxidation of a plating layer, the wiping gas is preferably a nitrogen ($N_2$) gas or an argon (Ar) gas.

In this case, a temperature of the wiping gas is preferably 30° C. or more, more preferably 40° C. or more, and most preferably 50° C. or more. According to the related art, a temperature of the wiping gas is controlled to be within a range of −20° C. to room temperature (25° C.) in order to significantly increase cooling efficiency. However, in order to significantly increase the contents of Al, Fe, and the like, contained in a Zn single phase structure, it is preferable to control a range of the temperature of the wiping gas to be increased.

Next, the zinc alloy plated steel sheet is primarily cooled. Primary cooling is an operation for sufficiently securing a Zn single phase structure as a microstructure observed in a cut cross section of a zinc alloy plating layer.

During the primary cooling, a cooling rate is preferably 5° C./sec or less (excluding 0° C./sec), more preferably 4° C./sec or less (excluding 0° C./sec), and most preferably 3° C./sec or less (excluding 0° C./sec). If the cooling rate exceeds 5° C./sec, coagulation of a Zn single phase structure begins from a surface of a plating layer, whose temperature is relatively low. Thus, a Zn single phase structure in a surface structure of the plating layer may be excessively formed. Meanwhile, as the cooling rate is slow, it is advantageous to secure a desired microstructure, so a lower limit of the cooling rate is not particularly limited during the primary cooling.

Moreover, during the primary cooling, a cooling end temperature is preferably more than 380° C. to 420° C. or less, more preferably 390° C. or more to 415° C. or less, and most preferably 395° C. or more to 405° C. or less. If the cooling end temperature is 380° C. or less, coagulation of a Zn single phase structure and coagulation of a portion of a Zn—Al—Mg-based intermetallic compound occur, so a desired structure may not be obtained. Meanwhile, if the cooling end temperature exceeds 420° C., coagulation of a Zn single phase structure may insufficiently occur.

Thereafter, the zinc alloy plated steel sheet is maintained at a constant temperature, such as the primary cooling end temperature.

When the zinc alloy plated steel sheet is maintained at a constant temperature, the holding time is preferably at least one second, more preferably 5 seconds or more, and most preferably at least 10 seconds. An alloy phase having a low coagulation temperature is provided to maintain a liquid phase and to induce partial coagulation of only a Zn single phase. Meanwhile, as a constant temperature holding time is longer, it is advantageous to secure a desired microstructure, so an upper limit of the constant temperature holding time is not particularly limited.

Thereafter, the zinc alloy plated steel sheet is secondarily cooled. Secondary cooling is an operation for sufficiently securing a Zn—Mg—Al-based intermetallic compound as a microstructure observed in a surface of a zinc alloy plated steel sheet, by coagulating a remaining liquid-phase plating layer.

During the secondary cooling, a cooling rate is preferably 10° C./sec or more, more preferably 15° C./sec or more, and most preferably 20° C./sec or more. As described above, during the secondary cooling, rapid cooling is performed, so coagulation of a remaining liquid-phase plating layer may be induced in a surface portion of a plating layer, whose temperature is relatively low. Thus, a Zn—Mg—Al-based intermetallic compound may be sufficiently secured as a surface structure of the plating layer. If the cooling rate is less than 10° C./sec, a Zn—Mg—Al-based intermetallic compound may be excessively formed in a cross-sectional structure of a plating layer, and a plating layer may be stuck on an upper roll of a plating device, and the like, and then may be dropped off. Meanwhile, as the cooling rate is increased, it is advantageous to secure a desired microstructure, so an upper limit of the cooling rate is not particularly limited during the secondary cooling.

Moreover, during the secondary cooling, a cooling end temperature is preferably 320° C. or less, more preferably 300° C. or less, and most preferably 280° C. or less. When the cooling end temperature is in the range described above, complete coagulation of a plating layer may be achieved. A change in a temperature of a steel sheet thereafter does not affect a fraction and a distribution of a microstructure of a plating layer, so is not particularly limited.

Hereinafter, the present invention will be described more specifically by way of examples. It should be noted, however, that the following examples are intended to illustrate and specify the present invention and not to limit the scope of the present invention. The scope of the present invention is determined by the matters described in the claims and matters able to be reasonably inferred from the claims.

MODE FOR INVENTION (Exemplary Embodiment 1)

After a low carbon cold-rolled steel sheet having a thickness of 0.8 mm, a width of 100 mm, and a length of 200 mm was prepared as a test piece for plating, that is, abase steel sheet, the base steel sheet was immersed in acetone, and then was ultrasonic cleaned to remove foreign substances such as rolling oil present on a surface, and the like. Thereafter, a surface of the test piece for plating was plasma treated so as to control an arithmetical average roughness Ra in a range of 1.0 μm to 1.1 μm. Thereafter, in a hot dipping site according to the related art, after a 750° C. reduction atmosphere heat treatment performed to secure mechanical properties of a steel sheet was performed, the base steel sheet was immersed in a plating bath having a composition in Table 1 to manufacture a zinc alloy plated steel sheet. In this case, regarding every exemplary embodiment, a plating bath temperature was uniformly 450° C., and a surface temperature of abase steel sheet entering the plating bath was uniformly 460° C. Thereafter, respective zinc alloy plated steel sheets, having been manufactured, had gas wiping applied thereto with a nitrogen ($N_2$) gas at 50° C. to control a plating adhesion amount to 70 g/m$^2$ per side, and cooling was performed under the conditions of Table 1.

Thereafter, a cross-sectional structure and a surface structure of the zinc alloy plated steel sheet were observed and analyzed, and a result thereof is illustrated in Table 2. A microstructure of a plating layer was observed by a FE-SEM (SUPRA-55VP, ZEISS). For example, the cross-sectional structure is taken at a magnification of 1,000 times and the surface structure is taken at a magnification of 300 times. A microstructure fraction was analyzed using an image analysis system.

Thereafter, the phosphatability and spot weldability of the zinc alloy plated steel sheet were evaluated, and a result thereof is illustrated in Table 2.

Phosphatability was evaluated by the following method.

First, prior to phosphate treatment, respective zinc alloy plated steel sheets, having been manufactured, were degreasing treated. In this case, an alkaline degreasing agent was used as a degreasing agent, and a degreasing treatment was performed in a 3 wt % aqueous solution at 45° C. for 120 seconds. Thereafter, after washing and surface modifying, the zinc alloy plated steel sheet was immersed in a phosphate treatment liquid, heated to 40° C. for 120 seconds, to form a zinc phosphate-based coating film. Thereafter, with respect to the zinc phosphate-based coating film, having been formed, a size of a crystal and uniformity of a coating film were evaluated. A size of a phosphate crystal was determined, as a surface was observed at a magnification of 1,000 times using a scanning electronic microscope (SEM), five large crystal sizes within a field of view were averaged, and five fields of view were checked and then were averaged.

Spot weldability was evaluated by the following method.

A Cu—Cr electrode having a tip diameter of 6 mm was used to allow a welding current of 7 kA to flow, and welding was continuously performed under conditions of a current carrying time of 11 Cycles (Here, 1 Cycle refers to 1/60 seconds, the same as above) and a holding time of 11 Cycles with a welding force of 2.1 kN. When a thickness of a steel sheet is t, based on a spot in which a diameter of a nugget is smaller than 4√t, spotting immediately before the spot was set as continuous spotting. Here, as the continuous spotting is greater, spot weldability is greater.

TABLE 1

| | Plating bath composition (wt %) | | Primary cooling condition | | Constant temperature maintenance condition | Secondary cooling condition | | |
|---|---|---|---|---|---|---|---|---|
| No. | Al | Mg | Cooling rate (° C./s) | End temperature (° C.) | Maintaining time (s) | Cooling rate (° C./s) | End temperature (° C.) | Remark |
| 1 | 0.2 | — | 2 | 400 | 10 | 20 | 280 | Comparative Example 1 |
| 2 | 0.5 | 0.7 | 2 | 400 | 10 | 20 | 280 | Comparative Example 2 |
| 3 | 0.8 | 0.9 | 2 | 400 | 10 | 20 | 280 | Inventive Example 1 |
| 4 | 1 | 1 | 2 | 400 | 10 | 20 | 280 | Inventive Example 2 |
| 5 | 1 | 1 | 12 | — | — | 12 | 280 | Comparative Example 3 |
| 6 | 1.2 | 1.2 | 12 | — | — | 12 | 280 | Comparative Example 4 |
| 7 | 1.3 | 1.4 | 12 | 400 | 10 | 12 | 280 | Inventive Example 3 |
| 8 | 1.6 | 1.6 | 2 | 400 | 10 | 20 | 280 | Inventive Example 4 |
| 9 | 1.6 | 1.6 | 12 | — | — | 12 | 280 | Comparative Example 5 |
| 10 | 2.5 | 2.5 | 2 | 400 | 10 | 20 | 280 | Inventive Example 5 |
| 11 | 3 | 3 | 2 | 400 | 10 | 20 | 280 | Comparative Example 6 |

Here, in Comparative Examples 3 through 5, without distinguishing primary cooling and secondary cooling, cooling is performed at the same speed to a secondary cooling end temperature.

TABLE 2

| No. | Cross-sectional structure (area %) Zn single phase | Zn—Al—Mg-based intermetallic compound | Surface structure (area %) Zn single phase | Zn—Al—Mg-based intermetallic compound | Phosphate crystal size (μm) | Continuous spotting | Remark |
|---|---|---|---|---|---|---|---|
| 1 | 100 | 0 | 100 | 0 | 9.5 | 650 | Comparative Example 1 |
| 2 | 97 | 3 | 83 | 17 | 8.9 | 630 | Comparative Example 2 |
| 3 | 93 | 7 | 36 | 64 | 2.4 | 610 | Inventive Example 1 |
| 4 | 91 | 9 | 21.3 | 78.7 | 2.1 | 600 | Inventive Example 2 |
| 5 | 92 | 8 | 53.8 | 46.2 | 6.8 | 650 | Comparative Example 3 |
| 6 | 89 | 11 | 62 | 38 | 4.1 | 610 | Comparative Example 4 |
| 7 | 73 | 27 | 14 | 86 | 1.8 | 615 | Inventive Example 3 |
| 8 | 62 | 38 | 17 | 83 | 1.8 | 580 | Inventive Example 4 |
| 9 | 85 | 15 | 41.6 | 58.4 | 5.3 | 600 | Comparative Example 5 |
| 10 | 61 | 39 | 11 | 89 | 2.2 | 580 | Inventive Example 5 |
| 11 | 21 | 79 | 7.2 | 92.8 | 1.9 | 200 | Comparative Example 6 |

Referring to Table 2, in a case of Inventive Examples 1 through 5 satisfying all the conditions of the present invention, it is confirmed that phosphatability and spot weldability are excellent simultaneously. On the other hand, in the case of Comparative Examples 1 through 5, spot weldability was excellent, but an area fraction of a Zn—Al—Mg-based intermetallic compound in a surface structure was low, so it was confirmed that phosphatability was inferior. In the case of Comparative Example 6, phosphatability was excellent, but an area fraction of a Zn single phase structure in a cross-sectional structure is low, so it was confirmed that spot weldability was inferior.

Meanwhile, FIG. 1 is SEM images of a cross-sectional structure of a zinc alloy plated steel sheet according to an exemplary embodiment. Respective images (a) through (f) of FIG. 1 are SEM images of cross-sectional structures according to Comparative Example 1, Inventive Example 2, Comparative Example 3, Inventive Example 4, Comparative Example 5, and Comparative Example 6. In addition, FIG. 2 is SEM images of a surface structure of a zinc alloy plated steel sheet according to an exemplary embodiment. Respective images (a) through (f) of FIG. 2 are SEM images of surface structures according to Comparative Example 1, Inventive Example 2, Comparative Example 3, Inventive Example 4, Comparative Example 5, and Comparative Example 6.

Moreover, FIG. 3 illustrates a surface, after a zinc alloy plated steel sheet according to an exemplary embodiment was phosphate-treated and the surface thereof was observed. Respective images (a) through (e) of FIG. 3 illustrate surfaces, after steel sheets according to Comparative Example 1, Inventive Example 2, Comparative Example 3, Inventive Example 4, and Comparative Example 5 were phosphate-treated and the surfaces thereof were observed. Referring to FIG. 3, it is visually confirmed that uniformity of a coating film according to Inventive Examples 1 and 4 is excellent.

(Exemplary Embodiment 2)

In Table 3, the content of each alloying element contained in a Zn single phase structure of a zinc alloy plated steel sheet according to an exemplary embodiment 1 and a corrosion resistance evaluation result are illustrated.

In this case, for measurement of the content of each alloying element contained in a Zn single phase structure, after a zinc alloy plated steel sheet was vertically cut, a cross-sectional image thereof was taken at a magnification of 3,000 times on a FE-SEM, and a EDS is used to point-analyze a Zn single phase structure, so the content of each alloying element was measured.

Moreover, for corrosion resistance evaluation, after each zinc alloy plated steel sheet was charged in a salt spray tester, the red rust occurrence time was measured by an international standard (ASTM B117-11). In this case, 5% salt water (at a temperature of 35° C., pH 6.8) was used, and 2 ml/80 $cm^2$ of salt water was sprayed per hour.

TABLE 3

| No. | Plating bath composition (wt %) Al | Mg | Alloy content of Zn single phase structure (wt %) Al | Fe | Mg | d/c | Salt water spraying time (h) | Remark |
|---|---|---|---|---|---|---|---|---|
| 1 | 0.8 | 0.9 | 1.69 | 1.8 | 0.02 | 2.11 | 530 | Inventive Example 1 |
| 2 | 1 | 1 | 1.38 | 2.3 | 0.01 | 1.38 | 610 | Inventive Example 2 |
| 3 | 1.3 | 1.4 | 1.84 | 2.5 | 0.02 | 1.41 | 600 | Inventive Example 3 |
| 4 | 1.6 | 1.6 | 1.71 | 2.1 | 0.02 | 1.06 | 650 | Inventive Example 4 |
| 5 | 2.5 | 2.5 | 1.62 | 3.2 | 0.01 | 0.648 | 780 | Inventive Example 5 |

c refers to the content of Al contained in a zinc alloy plating layer, and d refers to the content of Al contained in a Zn single phase structure.

Referring to Table 3, in a case of Inventive Examples 1 through 5 satisfying all the conditions of the present invention, the salt water spraying time was 500 hours or more, so it was confirmed that corrosion resistance was excellent.

While the present disclosure has been particularly shown and described with reference to exemplary embodiments thereof, but is not limited thereto. It will be apparent to those skilled in the art that various changes and modifications thereof may be made within the spirit and scope of the present disclosure, and therefore, it is to be understood that such changes and modifications belong to the scope of the appended claims.

The invention claimed is:

1. A zinc (Zn) alloy plated steel sheet, the zinc alloy plated steel sheet comprising a base steel sheet and a zinc alloy plating layer, wherein the zinc alloy plating layer includes 0.5 wt % to 2.8 wt % of aluminum (Al) and 0.5 wt % to 2.8 wt % of magnesium (Mg), with a remainder of Zn and inevitable impurities, a cross-sectional structure of the zinc alloy plating layer includes, by area percentage, a Zn single phase structure of more than 50% (excluding 100%) and a Zn—Al—Mg-based intermetallic compound of less than 50% (excluding 0%), and a surface structure of the zinc alloy plating layer includes, by area percentage, a Zn single phase structure of 40% or less (excluding 0%) and a Zn—Al—Mg-based intermetallic compound of 60% or more (excluding 100%).

2. The zinc alloy plated steel sheet of claim 1, the zinc alloy plating layer includes 0.8 wt % to 2.0 wt % of Al and 0.8 wt % to 2.0 wt % of Mg, with a remainder of Zn and inevitable impurities.

3. The zinc alloy plated steel sheet of claim 1, wherein, when an area percentage of the Zn single phase structure of the cross-sectional structure is a, and an area percentage of the Zn single phase structure of the surface structure is b, a ratio of b to a (b/a) is 0.8 or less.

4. The zinc alloy plated steel sheet of claim 1, wherein the Zn—Al—Mg-based intermetallic compound is at least one selected from the group consisting of a $Zn/Al/MgZn_2$ ternary eutectic structure, a $Zn/MgZn_2$ binary eutectic structure, a Zn—Al binary eutectic structure, and a $MgZn_2$ single phase structure.

5. The zinc alloy plated steel sheet of claim 1, wherein the Zn single phase structure includes 0.8 wt % or more of Al.

6. The zinc alloy plated steel sheet of claim 1, wherein, when the content of Al contained in the zinc alloy plating layer is c, and the content of Al contained in the Zn single phase structure is d, a ratio of d to c (d/c) is 0.6 or more.

7. The zinc alloy plated steel sheet of claim 1, wherein the Zn single phase structure contains 1 wt % or more of iron (Fe).

8. The zinc alloy plated steel sheet of claim 1, wherein the sum of the contents of Al and Fe contained in the Zn single phase structure is 8 wt % or less.

9. The zinc alloy plated steel sheet of claim 1, wherein the Zn single phase structure includes 0.1 wt % or less of Mg (including 0 wt %).

10. A method of manufacturing a zinc alloy plated steel sheet, the method comprising:

preparing a zinc alloy plating bath including 0.5 wt % to 2.8 wt % of Al and 0.5 wt % to 2.8 wt % of Mg, with a remainder of Zn and inevitable impurities;

immersing a base steel sheet in the zinc alloy plating bath, and obtaining a zinc alloy plated steel sheet by performing plating;

gas wiping the zinc alloy plated steel sheet;

primary cooling the zinc alloy plated steel sheet at a primary cooling rate of 5° C./sec or less (excluding 0° C./sec) to a primary cooling end temperature of more than 380° C. to 420° C. or less, after the gas wiping;

maintaining the zinc alloy plated steel sheet at a constant temperature for at least one second at the primary cooling end temperature, after the primary cooling; and secondary cooling the zinc alloy plated steel sheet at a secondary cooling rate of 10° C./sec or more to a secondary cooling end temperature of 320° C. or less, after the maintaining the zinc alloy plated steel sheet at a constant temperature.

11. The method of claim 10, further comprising: activating a surface of the base steel sheet, before the base steel sheet is immersed in the zinc alloy plating bath.

12. The method of claim 11, wherein the activating a surface of the base steel sheet is performed by a plasma treatment or an excimer laser treatment.

13. The method of claim 11, wherein an arithmetical average roughness Ra of the base steel sheet, having been surface activated, is 0.8 μm to 1.2 μm.

14. The method of claim 10, wherein a temperature of the zinc alloy plating bath is from 440° C. to 460° C.

15. The method of claim 10, wherein a surface temperature of the base steel sheet entering the zinc alloy plating bath is higher than a temperature of the zinc alloy plating bath by 5° C. to 20° C.

16. The method of claim 10, wherein the zinc alloy plating bath includes 0.8 wt % to 2.0 wt % of Al and 0.8 wt % to 2.0 wt % of Mg, with a remainder of Zn and inevitable impurities.

17. The method of claim 10, wherein a temperature of a wiping gas is 30° C. or more, during the gas wiping.

18. The method of claim 10, wherein the primary cooling rate is 3° C./sec or less (excluding 0° C./sec).

19. The method of claim 10, wherein the primary cooling end temperature is from 400° C. or more to 410° C. or less.

20. The method of claim 10, wherein the zinc alloy plated steel sheet is maintained at the primary cooling end temperature for at least 10 seconds, during the maintaining the zinc alloy plated steel sheet at a constant temperature.

21. The method of claim 10, wherein the secondary cooling rate is 20° C./sec or more.

* * * * *